US005806340A

United States Patent [19]

Tomita

[11] Patent Number: 5,806,340

[45] Date of Patent: Sep. 15, 1998

[54] HIGH PURITY NITROGEN GENERATOR UNIT AND METHOD

[75] Inventor: Shinji Tomita, Hyogo-ken, Japan

[73] Assignee: Teisan Kabushiki Kaisha, Tokyo, Japan

[21] Appl. No.: 856,003

[22] Filed: May 14, 1997

[51] Int. Cl.[6] ..... F25J 3/04

[52] U.S. Cl. ..... 62/644; 62/652

[58] Field of Search ..... 62/646, 644, 649, 62/652, 903

[56] References Cited

U.S. PATENT DOCUMENTS

| | | | |
|---|---|---|---|
| 4,705,548 | 11/1987 | Agrawal et al. | 62/645 |
| 4,848,996 | 7/1989 | Thorogood et al. | 62/652 |
| 4,869,742 | 9/1989 | Thorogood et al. | 62/652 |
| 5,349,822 | 9/1994 | Nagamura et al. | 62/652 |
| 5,511,380 | 4/1996 | Ha | 62/645 X |
| 5,546,765 | 8/1996 | Nagamura et al. | 62/652 X |
| 5,582,034 | 12/1996 | Naumovitz | 62/652 |
| 5,711,167 | 1/1998 | Ha et al. | 62/652 |

*Primary Examiner*—Christopher Kilner

*Attorney, Agent, or Firm*—Young & Thompson

[57] ABSTRACT

A high purity nitrogen generator unit which is excellent in the energy efficiency and the recovery of high purity nitrogen gas, is provided. In a rectification column 1, feed air is separated to oxygen-rich liquid air and nitrogen gas. The oxygen-rich liquid air in its bottom is reduced in pressure by a first expansion valve 21 and sent to a composition regulation column 3. The nitrogen gas in its top is condensed in a nitrogen condenser 2, the resulting liquid nitrogen is returned as a reflux liquid to the rectification column 1 and non-condensed gas is released. After oxygen-rich waste gas in the lower part of the composition regulation column 3 is reduced in pressure by an expansion turbine 6, it is released by way of a first heat exchanger 4. Mixed gas in the top of the composition regulation column 3 is introduced for re-circulation into a first compressor 5. Another portion of the mixed gas is returned to the composition regulation column 3 by way of a second compressor 7, second heat exchanger 8 and second expansion valve 22. The second compressor 7 is driven by means of the expansion turbine 6. High purity liquid nitrogen taken out of the vicinity of the top of the rectification column 1 is evaporated for recovery in the second heat exchanger 8.

16 Claims, 7 Drawing Sheets

HIGH PURITY NITROGEN GENERATOR UNIT AND METHOD

DETAILED DESCRIPTION OF THE INVENTION

1. Technical Field

The present invention relates to a generator unit for producing high purity nitrogen gas free of low boiling point components such as hydrogen, helium and neon.

2. Prior Art

As a nitrogen gas generator unit, there has been used a unit in which nitrogen gas is separated from air by use of a rectification column.

In such type of unit, compressed air freed of moisture and carbon dioxide is cooled down through a heat exchange with nitrogen gas to be recovered as a product, and then introduced into the vicinity of the bottom of a rectification column so as to be brought in a counter-current contact with a reflux liquid as it is rising through its rectifying trays, whereby oxygen-rich liquid air is reservoired in the bottom of the rectification column and at the same time, nitrogen gas collected in the top of the rectification column is recovered as a product. In such a process as mentioned above, there is a defect that the nitrogen gas produced in accordance therewith is not suitable for use in a semiconductor industry or the like because it still contains low boiling point components such as hydrogen, although high boiling point components such as oxygen and hydrocarbons can be removed to a level of sub ppb.

As a unit of producing high purity nitrogen gas free of low boiling point components, in which such a defect as mentioned above is eliminated, there is for example such a unit as disclosed in the official gazette of Japanese Utility Model Publication No. 10,544/1992. The outline of this unit will be illustrated in FIG. 7.

In FIG. 7, the reference numeral 1 represents a rectification column, 2 represents a nitrogen condenser, 4 represents a main heat exchanger, 6 represents an expansion turbine, and 21 and 26 each represents an expansion valve.

Feed air is compressed and freed of moisture and carbon dioxide. Then, the feed air is introduced into the main heat exchanger 4 through a pipe 41, where it is cooled down by oxygen-rich waste gas to be released here and high purity nitrogen gas to be recovered as a product, and the thus-cooled feed air is thereafter introduced under a state that its pressure is about 9.3 kg/cm$^2$G and its temperature is about −165° C. into below the rectifying trays 11 of said rectification column 1 by way of a pipe 42.

The feed air is brought in a counter-current contact with a reflux liquid flowing down from above, which will be mentioned below, as it rises through the rectifying trays 11, whereby oxygen in the feed air is caught into the reflux liquid while nitrogen in the reflux liquid is evaporated so as to be caught into the gas phase. As a result, nitrogen gas containing low boiling point components such as hydrogen and helium is separated in the top 15 of the rectification column 1 and oxygen-rich liquid air in the bottom 16 of the rectification column 1, respectively.

The nitrogen gas collected in the column top 15 is sent to the nitrogen condenser 2 by way of a pipe 61, where it is cooled down through an indirect heat exchange with oxygen-rich liquid air and high purity liquid nitrogen, which will be mentioned below. Liquid nitrogen which has been cooled down and liquefied in the nitrogen condenser 2 is returned to the column top 15 by way of a pipe 62 and supplied as a reflux liquid to the rectifying trays 11. On the other hand, non-condensed gas in which low boiling point components such as hydrogen and helium have been concentrated is released out of the system by way of a pipe 63.

The oxygen-rich liquid air having a temperature of about −165° C., collected in the bottom 16 of the rectification column 1, is sent to the expansion valve 21 by way of a pipe 71, where it is cooled down through its reduction in pressure to about 3.3 kg/cm$^2$G, and then sent to the nitrogen condenser 2. In the nitrogen condenser 2, the oxygen-rich liquid air sent therein is evaporated through an indirect heat exchange with said nitrogen gas so as to become oxygen-rich waste gas having a temperature of about −173° C., and this waste gas is sent to the main heat exchanger 4 by way of a pipe 73. The oxygen-rich air is further taken out at about −115° C. from the way of the main heat exchanger 4 and sent to the expansion turbine 6 by way of a pipe 74, where it is cooled down through its reduction in pressure (about 0.3 kg/cm$^2$G, −152° C.) and then returned to the main heat exchanger 4 again. In the main heat exchanger 4, the cooled oxygen-rich air is used for cooling down the feed air so as to be elevated in temperature to normal temperature, and then released out of the system by way of a pipe 76.

From a reservoir part 11*b* provided at a rectifying tray that is several stages below the top 15 of the rectification column 1, high purity liquid nitrogen free of low boiling point components, in which the content of impurities is at a level of sub ppb, is taken out by way of a pipe 101, reduced in pressure to about 8.5 kg/Cm$^2$G by means of the expansion valve 26, and then sent to the nitrogen condenser 2. In the same nitrogen condenser 2, the liquid nitrogen sent therein is evaporated through an indirect heat exchange with said nitrogen gas, and then sent to the main heat exchanger 4 by way of a pipe 103, and in the same main heat exchanger 4, the nitrogen gas sent therein is used for cooling down the feed air so as to be elevated in temperature to normal temperature, and then recovered as a product of high purity nitrogen gas (a pressure of about 8.4 kg/cm$^2$G) by way of a pipe 53.

In the unit shown in FIG. 7, latent heat of the nitrogen gas in the top 15 of the rectification column 1 in its condensation is utilized as a heating source for evaporating the high purity liquid nitrogen. In order to obtain a temperature difference enough for evaporating the high purity liquid nitrogen, the rectification column 1 must be therefore operated at a pressure that is higher by about 0.5 kg/cm$^2$ than a pressure demanded as a product of high purity nitrogen gas. Accordingly, a waste of energy has resulted because the feed air is excessively compressed.

Further, there is a method of heating and evaporating high purity liquid nitrogen by using feed air exclusively. As one example thereof, a unit disclosed in the official gazette of Japanese Utility Model Publication No. 10,545/1992 is shown in FIG. 8. In addition, the common parts as in FIG. 7 are given the same reference numerals and their explanation will be omitted.

In this example, an auxiliary heat exchanger 8*b* is provided in addition to a main heat exchanger 4. After high purity liquid nitrogen free of low boiling point components is taken out of a reservoir part 11*b* provided at a rectifying tray that is several stages below the column top of a rectification column 1 by way of a pipe 111, and reduced in pressure by an expansion valve 28, it is evaporated in the auxiliary heat exchanger 8*b* and main heat exchanger 4 through an indirect heat exchange with feed air fed therein, and recovered as a product of high purity nitrogen gas by way of a pipe 53.

In the case of such a method in which feed air is exclusively used for evaporating high purity liquid nitrogen, a gas load of the rectification column 1 is decreased because a portion of the feed air is liquefied, and at the same time, a ratio of the nitrogen gas separated in the column top 15 is also decreased. As a result, the amount of a reflux liquid condensed in the nitrogen condenser 2 and returned to the column top 15 is also decreased. Accordingly, there are problems that it is necessary to install an excess of rectifying trays 11 and the recovery of the high purity nitrogen gas is lower.

OBJECT OF THE INVENTION

Due to consideration of the aforementioned problems, the present invention has been achieved. It is an abject of the present invention to provide a high purity nitrogen generator unit which is excellent in the energy efficiency and has a higher recovery of high purity nitrogen gas.

The high purity nitrogen generator unit according to the present invention comprises:

a first heat exchanger for cooling down feed compressed air;

a rectification column having rectifying trays, where the compressed air is introduced from the first heat exchanger into below said rectifying trays so as to be brought in a counter-current contact with a reflux liquid, whereby oxygen-rich liquid air is separated in its bottom and nitrogen gas in its top, respectively;

a first expansion valve for cooling down said oxygen-rich liquid air, introduced therein, through its reduction in pressure;

a composition regulation column having rectifying trays, where said oxygen-rich liquid air is introduced from the first expansion valve into above said rectifying trays, whereby oxygen-rich liquid air is separated in its bottom and a mixed gas of oxygen and nitrogen in its top, respectively;

a nitrogen condenser for cooling down said nitrogen gas introduced therein from the top of said rectification column through an indirect heat exchange with said oxygen-rich liquid air collected in the bottom of said composition regulation column, whereby the thus-condensed liquid nitrogen is supplied as said reflux liquid to above the rectifying trays of the rectification column and non-condensed gas is discharged to the outside;

a gas discharge line having an expansion turbine provided on the way, where oxygen-rich waste gas is recovered from the gas phase portion below the rectifying trays of the composition regulation column and introduced into this expansion turbine, and the oxygen-rich waste gas thus cooled through its reduction in pressure is introduced as a portion of a cooling medium into the first heat exchanger and then discharged to the outside;

a first circulation line having a first compressor provided on the way, where a portion of said mixed gas is introduced from the top of the composition regulation column into the first compressor, and the thus-compressed mixed gas is joined with said feed compressed air:

a second circulation line having a second compressor driven by said expansion turbine, a second heat exchanger and a second expansion valve, provided on the way, where another portion of said mixed gas is introduced from the top of the composition regulation column into the second compressor, and the thus-compressed mixed gas is introduced as a heating medium into the second heat exchanger and then introduced into the second expansion valve so as to be liquefied through its reduction in pressure, and the thus-liquefied gas is returned to above the rectifying trays of the composition regulation column; and a product gas recovery line for recovering high purity liquid nitrogen from a rectifying tray that is several stages below the top of the rectification column and bringing the recovered liquid nitrogen into a heat exchange with said mixed gas in the second heat exchanger, where the thus-evaporated high purity nitrogen gas is introduced as a portion of a cooling medium into the first heat exchanger and then recovered as a product.

In the next place, a process of producing high purity nitrogen gas by use of the aforementioned unit will be described.

Feed air is compressed and freed of moisture and carbon dioxide. Then, the feed air is introduced into the first heat exchanger, where it is cooled down by oxygen-rich waste gas to be released here and high purity nitrogen gas to be recovered as a product, and the thus-cooled feed air is thereafter introduced into below the rectifying trays of the rectification column.

The feed air is brought in a counter-current contact with a reflux liquid flowing down from above, which will be mentioned below, as it rises through the rectifying trays, whereby oxygen in the feed air is caught into the reflux liquid while nitrogen in the reflux liquid is evaporated so as to be caught into the gas phase. As a result, nitrogen gas containing low boiling point components such as hydrogen and helium is separated in the top of the rectification column and oxygen-rich liquid air in the bottom of the rectification column, respectively.

The oxygen-rich liquid air collected in the bottom of the rectification column is introduced into the first expansion valve, where it is cooled down through its reduction in pressure and then introduced into above the rectifying trays of the composition regulation column. A portion of the oxygen-rich liquid air is evaporated as it rises through the rectifying trays, whereby a mixed gas of oxygen and nitrogen is collected in the top of the composition regulation column and oxygen-rich liquid air, in which the concentration of oxygen has been further enhanced, in the bottom of the composition regulation column, respectively.

The nitrogen gas collected in the top of the rectification column is sent to the nitrogen condenser, where it is cooled down through an indirect heat exchange with said oxygen-rich liquid air collected in the bottom of the composition regulation column. The thus-cooled, condensed liquid nitrogen is returned to above the rectifying trays of the rectification column and supplied as a reflux liquid to the rectifying trays. On the other hand, the non-condensed gas, in which the low boiling point components such as hydrogen and helium have been concentrated, is released out of the system.

From the gas phase below the rectifying trays of the composition regulation column, oxygen-rich waste gas is taken out and introduced into the expansion turbine through the gas discharge line. After the oxygen-rich waste gas is cooled down through its reduction in pressure in the same expansion turbine, it is introduced into the first heat exchanger, where it is used for cooling the feed air and then released out of the system.

On the other hand, a portion of said mixed gas taken out of the top of the composition regulation column is introduced into the first compressor through the first circulation line, where it is elevated in pressure. Thereafter, the mixed gas thus-elevated in pressure is circulated again after joined with the feed compressed air.

Another portion of said mixed gas taken out of the top of the composition regulation column is introduced into the second compressor through the second circulation line, where it is elevated in pressure and elevated in temperature. Thereafter, the mixed gas thus-elevated in pressure is introduced as a heating medium into the second heat exchanger. Thus, the mixed gas is cooled down through a heat exchange with high purity liquid nitrogen, which will be mentioned below, in the second heat exchanger, and further fed into the second expansion valve, where it is cooled down through its reduction in pressure and then returned to above the rectifying trays of the composition regulation column. In addition, said second compressor is driven by means of said expansion turbine.

From a rectifying tray that is several stages below the top of the rectification column, high purity liquid nitrogen free of low boiling point components is taken out, and introduced into the second heat exchanger through the product gas recovery line. In the same second heat exchanger, the liquid nitrogen introduced therein is evaporated through an indirect heat exchange with said mixed gas, and then sent to the first heat exchanger, and in the same first heat exchanger, the nitrogen gas sent therein is used for cooling down the feed air so as to be elevated in temperature to normal temperature, and then recovered as a product of high purity nitrogen gas.

As a variant of the aforementioned construction, said second circulation line may be also constructed such that the mixed gas taken out of the top of the composition regulation column is returned to the bottom of the composition regulation column by way of the second compressor, second heat exchanger and second expansion valve.

As another variant of the aforementioned construction, said second circulation line may be also constructed such that the oxygen-rich waste gas taken out of the gas phase portion below the rectifying trays of the composition regulation column is returned to the bottom of the composition regulation column by way of the second compressor, second heat exchanger and second expansion valve.

As a further variant of the aforementioned construction, said second circulation line may be also constructed such that the oxygen-rich waste gas taken out of the gas phase portion below the rectifying trays of the composition regulation column is returned to the bottom of the composition regulation column by way of the second compressor, first heat exchanger, second heat exchanger and second expansion valve.

As a further variant of the aforementioned construction, furthermore, said second circulation line may be also constructed such that a portion of said mixed gas taken out of the top of the composition regulation column is joined with said feed air in an intermediary part of the first heat exchanger by way of the second compressor.

In each of the aforementioned constructions, said second heat exchanger may be disposed at a position that is about 10 m to 15 m lower than a place where high purity liquid nitrogen is taken out of said rectification column, whereby a pressure obtained by adding a pressure corresponding to said head difference to the operation pressure of the rectification column can be given to the high purity nitrogen gas to be delivered.

As a variant of each the aforementioned constructions, furthermore, such a construction may be effective that said second heat exchanger is composed of a heat exchanger body and a gas-liquid separator, said gas-liquid separator is connected in parallel to a route of said heat exchanger body on the cooling medium side, and said product gas recovery line is connected to the gas-liquid separator so that high purity liquid nitrogen is evaporated in this gas-liquid separator. In the case of such construction, high purity liquid nitrogen is introduced from the rectification column into said gas-liquid separator, and high purity liquid nitrogen is further introduced from the liquid phase portion of the gas-liquid separator into the heat exchanger body so as to be brought in an indirect heat exchange with said mixed gas or oxygen-rich waste gas, and returned to the gas-liquid separator as a portion thereof is evaporated, and the thus-generated high purity nitrogen gas is recovered as a product by way of the product gas recovery line.

FIG. 1 shows one example of the embodiments of the present invention. In the figure, the reference numeral 1 represents a rectification column, 2 represents a nitrogen condenser, 3 represents a composition regulation column, 4 represents a first heat exchanger, 5 represents a first compressor (a recycle compressor), 6 represents an expansion turbine, 7 represents a second compressor, 8 represents a second heat exchanger, 21 represents a first expansion valve and 22 represents a second expansion valve, respectively.

The rectification column 1 has rectifying trays 11 provided in its inside. Above the rectification column 1 is disposed the composition regulation column 3. This composition regulation column 3 has rectifying trays 31 provided in its inside. In the bottom of the composition regulation column 3 is incorporated the nitrogen condenser 2. The first heat exchanger 4 has, in its inside, a route 4*b* for feed compressed air, and has further routes (4*a*, 4*c*, 4*d*) for oxygen-rich waste gas used as a medium on the cooling side, recycle gas (a mixed gas of oxygen and nitrogen) and high purity nitrogen gas (a product).

The supply route 4*b* for the feed compressed air has a feed air compressor 25, a molecular sieves column 26, a feed air supply pipe 41 and the first heat exchanger 4, provided in order from the upperstream side. This feed air route 4*b* of the first heat exchanger 4 is connected to below the rectifying trays 11 of the rectification column 1 by way of a pipe 42.

Into the liquid phase portion in the bottom 16 of the rectification column 1 is connected a pipe 71. This pipe 71 is connected to above the rectifying trays 31 of the composition regulation column 3 by way of the expansion valve 21.

The top 15 of the rectification column 1 is connected to the inlet side of the nitrogen condenser 2 by way of a pipe 61, and the outlet side of the nitrogen condenser 2 is connected to above the rectifying tray 11*a* of the rectification column 1 by way of a pipe 62.

To a reservoir part 11*b* provided at a rectifying tray that is several stages below the top 15 of the rectification column is connected a pipe 51 for recovering high purity liquid nitrogen. The other end of said pipe 51 is connected to the second heat exchanger 8 and further connected therefrom to the high purity nitrogen gas route 4*d* of the first heat exchanger 4. In addition, the second heat exchanger 8 is disposed at a level that is separated downward far away from a place where said pipe 51 is connected to the rectification column 1, whereby a pressure corresponding to a head difference is caused to act upon the high purity liquid nitrogen in the inside of the second heat exchanger 8.

To below, at 37, the rectifying trays of the composition regulation column 3 is connected a pipe 81. This pipe 81 is connected to the inlet side of the expansion turbine 6 by way of the first heat exchanger 4 and a pipe 82. The outlet side of the expansion turbine 6 is connected to the oxygen-rich waste gas route 4*a* of the first heat exchanger 4 by way of a pipe 83. Thus, a gas discharge line is made up. In addition, the expansion turbine 6 has a bypass pipe 84 provided in parallel thereto.

The top 35 of the composition regulation column 3 is connected to the recycle gas route 4*c* of the first heat exchanger 4 by way of a pipe 91 and further connected therefrom to the inlet side of the first compressor 5 by way of a pipe 92. The outlet side of the first compressor 5 is connected to the way of a feed air supply pipe 41 by way of a pipe 93. Thus, a first circulation line is made up.

A pipe 95 branched from the way of said pipe 91 is connected to the inlet side of the second compressor 7. The outlet side of the same second compressor 7 is connected to the route of the second heat exchanger 8 on the heating medium side by way of a pipe 96, connected therefrom to the second expansion valve 22 by way of a pipe 97, and further connected therefrom to above the rectifying trays 31 of the composition regulation column 3. Thus, a second circulation line is made up. In addition, a shaft of the second compressor 7 is connected with a shaft of said expansion turbine 6.

In the next place, a process for producing high purity nitrogen gas by use of the aforementioned unit will be described.

Feed air which has been elevated in pressure to about 8.3 kg/cm$^2$G by means of the feed air compressor 25 is introduced into the molecular sieves column 26, where it is freed of moisture and carbon dioxide. Then, the resulting feed air is introduced into the first heat exchanger 4 through the feed air supply pipe 41. After the feed air is cooled down, in the first heat exchanger 4, by oxygen-rich waste gas to be released and high purity nitrogen gas to be recovered as a product, it is introduced under a state that its pressure is about 8.1 kg/cm$^2$G and its temperature is about −167° C. into below the rectifying trays 11 of the rectification column 1 through the pipe 42.

In the rectification column 1, the feed air is brought in a counter-current contact with a reflux liquid flowing down from above, which will be mentioned below, as it rises through the rectifying trays 11, whereby oxygen in the feed air is caught into the reflux liquid while nitrogen in the reflux liquid is evaporated and caught into the gas phase. As a result, nitrogen gas (1 ppb or less of oxygen) containing low boiling point components such as hydrogen and helium is separated into the top 15 of the rectification column 1 and oxygen-rich liquid air (about 30 vol % of oxygen) into the bottom 16 of the rectification column 1, respectively.

The oxygen-rich liquid air having a temperature of about −168° C., collected in the bottom 16 of the rectification column 1, is introduced into the first expansion valve 21 through the pipe 71, where it is cooled down through its reduction in pressure. Then, the resulting feed air is introduced under a state that its pressure is about 2.7 kg/cm$^2$G and its temperature is about −180° C. into above the rectifying trays 31 of the composition regulation column 3. In the composition regulation column 3, a portion of oxygen-rich liquid air is evaporated as it flows down through the rectifying trays 31, whereby a mixed gas (about 19 vol % of oxygen) of oxygen and nitrogen is collected in the top 35 of the composition regulation column 3 and oxygen-rich liquid air (about 55 vol % of oxygen), in which the concentration of oxygen has been further enhanced, in the bottom 36 of the composition regulation column 3, respectively.

The nitrogen gas collected in the top 15 of the rectification column 1 is sent to the nitrogen condenser 2 through the pipe 61, where it is cooled down through an indirect heat exchange with said oxygen-rich liquid air collected in the bottom 36 of the composition regulation column 3. The thus-cooled, condensed liquid nitrogen is returned to above the rectifying tray 11*a* of the rectification column 1 through the pipe 62 so as to be supplied as a reflux liquid to the rectifying trays. On the other hand, non-condensed gas, in which low boiling point components such as hydrogen and helium have been concentrated, is released out of the system through the pipe 63.

From the gas phase 37 below the rectifying trays 31 of the composition regulation column 3, oxygen-rich waste gas (about 55 vol % of oxygen) having a temperature of about −173° C. is taken out and introduced into the first heat exchanger 4 through the pipe 81 (the gas discharge line). The oxygen-rich waste gas is taken out, at a temperature of about −145° C., from the way of the first heat exchanger 4 and introduced into the expansion turbine 6. After the oxygen-rich waste gas is cooled down through its reduction in pressure in the same expansion turbine 6, it is introduced under a state that its pressure is about 0.3 kg/cm$^2$G and its temperature is about −165° C. into the main heat exchanger 4 again, where it is used for cooling down the feed air so as to get normal temperature. Thereafter, the resulting oxygen-rich waste gas is released out of the system. In addition, this oxygen-rich waste gas will be optionally used for regeneration of the molecular sieves column 26.

On the other hand, a portion of said mixed gas taken out of the top 35 of the composition regulation column 3 by way of the pipe 91 (the first circulation line) is introduced into the first heat exchanger 4, where it is used for cooling down the feed air. Then, the mixed gas is introduced into the first compressor 5 through the pipe 92, where it is elevated in pressure to a pressure of about 8.2 kg/cm$^2$G. Thereafter, the resulting mixed gas is joined for re-circulation with the feed air supply pipe 41 through the pipe 93.

Another portion of said mixed gas taken out of the top 35 of the composition regulation column 3 by way of the pipe 91 is introduced into the second compressor 7 through the pipe 95 (the second circulation line), where it is elevated in pressure and elevated in temperature. Then, the resulting mixed gas is introduced under a state that its pressure is about 8.2 kg/cm$^2$G and its temperature is about −155° C. into the second heat exchanger 8 as a heating medium through the pipe 96. The mixed gas is cooled down to a temperature of about −169° C. through a heat exchange with high purity liquid nitrogen, which will be mentioned below, in the second heat exchanger 8, and further led to the second expansion valve 22 through the pipe 97, where it is cooled down through its reduction in pressure. Thereafter, the resulting mixed gas is returned under a state that its pressure is about 2.7 kg/cm$^2$G and its temperature is about −181° C. into above the rectifying trays 31 of the composition regulation column 3. In addition, the shaft of the second compressor 7 is connected with the shaft of said expansion turbine 6 and hence the second compressor 7 is driven by the expansion turbine 6.

From the reservoir part 11*b* provided at a rectifying tray that is several stages below the top 15 of the rectification column 1, high purity liquid nitrogen free of low boiling point components such as hydrogen and helium is taken out at a temperature of about −172° C., and introduced into the second heat exchanger 8 through the pipe 51 (the product gas recovery line). The high purity nitrogen gas which has been evaporated through an indirect heat exchange with said mixed gas in the second heat exchanger 8 is sent at a temperature of about −172° C. to the main heat exchanger 4, where it is used for cooling down the feed air so as to be elevated in temperature up to normal temperature. Then, the resulting high purity nitrogen gas is sent to a flow rate regulation valve 27 through a pipe 53 so as to be regulated in flow rate, taken out at a pressure of 8.4 kg/cm$^2$G, and freed of particles by means of a filter 29. Thereafter, this high purity nitrogen gas is recovered as a product of high purity nitrogen gas.

In addition, the second heat exchanger 8 is disposed at a level that is about 10 m–15 m below a place where the pipe 51 is connected to the rectification column 1, whereby a pressure obtained by adding a pressure as high as about 0.7–1.0 kg/cm$^2$ that corresponds to a head difference to the operation pressure of the rectification column 1, this is about 7.8 kg/cm$^2$G (at its column top), is caused to act upon the high purity nitrogen gas in the inside of the second heat exchanger 8.

The recovery of the high purity nitrogen gas in the aforementioned process is about 62 vol % of the feed air charged therein.

FIG. 2 shows another example of the embodiments according to the present invention. In the figure, the reference numeral 8*a* represents a heat exchanger body and 9 represents a gas-liquid separator, respectively.

In this example, the second heat exchanger which has been used in the former example is composed of two separate parts, i.e. a heat exchanger body 8*a* and a gas-liquid separator 9. Namely, the gas-liquid separator 9 is connected in parallel to a route of the heat exchanger body 8*a* on the cooling medium side and the pipe 51 (the product gas recovery line) is connected to the gas-liquid separator 9, and high purity liquid nitrogen is evaporated in the heat exchanger body 8*a*. The construction other than this point is common to the example illustrated in FIG. 1.

In a case of the aforementioned construction, high purity liquid nitrogen is introduced from the rectification column 1 into the gas-liquid separator 9, and further, high purity liquid nitrogen is introduced from the liquid phase portion of the gas-liquid separator 9 into the heat exchanger body 8*a* by way of a pipe 58 so as to be brought in a heat exchange with said mixed gas. The resulting high purity liquid nitrogen is returned to the gas-liquid separator 9 by way of a pipe 59 as a portion thereof is evaporated. The thus-generated high purity nitrogen gas will be recovered as a product by way of the pipe 52, first heat exchanger 4 and pipe 53.

FIG. 3 shows a further example of the embodiments according to the present invention. This example is constructed such that the bottom 36 of the composition regulation column 3 is determined as a place of destination, to which the second circulation line is to be returned. The construction other than this point is common to the example of FIG. 1.

In this case, the operation pressure of the rectification column 1 is about 7.8 kg/cm$^2$G at its column top and the operation pressure of the composition regulation column 3 is about 2.7 kg/cm$^2$G, whereby the recovery of the high purity nitrogen gas becomes about 62 vol %.

Another portion of said mixed gas taken out of the top 35 of the composition regulation column 3 by way of the pipe 91 is introduced into the second compressor 7 through the pipe 95 (the second circulation line), where it is elevated in pressure and elevated in temperature. Then, the resulting mixed gas is introduced under a state that its pressure is about 8.2 kg/cm$^2$G and its temperature is about −155° C. into the second heat exchanger 8 as a heating medium through the pipe 96. The mixed gas is cooled down to a temperature of about −169° C. through a heat exchange with the high purity liquid nitrogen in the second heat exchanger 8, and further led to the second expansion valve 22 through the pipe 97, where it is cooled down through its reduction in pressure. Thereafter, the resulting mixed gas is returned under a state that its pressure is about 2.7 kg/cm$^2$G and its temperature is about −181° C. into the bottom 36 of the composition regulation column 3.

FIG. 4 shows a further example of the embodiments according to the present invention. In this example, the second circulation line is constructed such that a portion of the oxygen-rich waste gas taken out of the gas phase portion 37 below the rectifying trays of the composition regulation column 3 is returned to the bottom 36 of the composition regulation column 3 by way of the second compressor 7, second heat exchanger 8 and second expansion valve 22. The construction other than this point is common to the example illustrated in FIG. 1.

In this case, the operation pressure of the rectification column 1 is about 7.8 kg/Cm$^2$G at its column top and the operation pressure of the composition regulation column 3 is about 2.7 kg/cm$^2$G, whereby the recovery of the high purity nitrogen gas becomes about 62 vol %.

A portion of the oxygen-rich waste gas taken out of the gas phase portion 37 below the rectifying trays of the composition regulation column 3 by way of the pipe 81 is introduced into the second compressor 7 through the pipe 95 (the second circulation line), where it is elevated in pressure and elevated in temperature. Then, the resulting oxygen-rich waste gas is introduced under a state that its pressure is about 5.4 kg/cm$^2$G and its temperature is about −155° C. into the second heat exchanger 8 as a heating medium through the pipe 96. The oxygen-rich waste gas is cooled down to a temperature of about 169° C. through a heat exchange with the high purity liquid nitrogen in the second heat exchanger 8, and further led to the second expansion valve 22 through the pipe 97, where it is cooled down through its reduction in pressure. Thereafter, the resulting oxygen-rich waste gas is returned under a state that its pressure is about 2.7 kg/cm$^2$G and its temperature is about −176° C. into the bottom 36 of the composition regulation column 3.

FIG. 4 shows a further example of the embodiments according to the present invention. In this example, the second circulation line is constructed such that a portion of the oxygen-rich waste gas taken out of the gas phase portion 37 below the rectifying trays of the composition regulation column 3 is returned to the bottom 36 of the composition regulation column 3 by way of the second compressor 7, first heat exchanger 4, second heat exchanger 8 and second expansion valve 22.

In this example, the said portion of the oxygen-rich waste gas is introduced from the outlet side of the second compressor 7 into the way of the first heat exchanger 4 by way of a pipe 98, where it is cooled down. Then, the resulting oxygen-rich waste gas is taken out of the way of the first heat exchanger 4, and introduced into the second heat exchanger 8 by way of a pipe 99. The construction other than this point is common to the example illustrated in FIG. 4.

FIG. 6 shows a further example of the embodiments according to the present invention. This example is constructed such that the feed air pipe of the second heat exchanger 8 on the upperstream side is determined as a place of destination, to which the second circulation line is to be returned. The construction other than this point is common to the example of FIG. 1.

In this case, the operation pressure of the rectification column 1 is about 7.8 kg/cm$^2$G at its column top and the operation pressure of the composition regulation column 3 is about 2.7 kg/cm$^2$G, whereby the recovery of the high purity nitrogen gas becomes about 62 vol %.

Another portion of said mixed gas taken out of the top 35 of the composition regulation column 3 by way of the pipe 91 is introduced into the second compressor 7 through the pipe 95 (the second circulation line), where it is elevated in pressure and elevated in temperature. Then, the resulting mixed gas is joined, under a state that its pressure is about 8.2 kg/cm$^2$G and its temperature is about −155° C., with the feed compressed air route 4*b* on the way of the first heat exchanger 4 through the pipe 96.

In the high purity nitrogen generator unit based on the present invention, oxygen-rich liquid air separated in the bottom of a rectification column is led to a composition regulation column, and a portion of the oxygen-rich liquid air is evaporated there, whereby it is separated to a mixed gas of oxygen and nitrogen and oxygen-rich liquid air in which oxygen has been further concentrated. Then, this mixed gas is re-circulated as a feed material, and this oxygen-rich liquid air in which oxygen has been further concentrated is released out of the system in a state of oxygen-rich waste gas.

The pressure of this oxygen-rich waste gas is recovered as a power by use of an expansion turbine, a portion of the mixed gas to be re-circulated (or a portion of the oxygen-rich waste gas) is compressed by use of this power, and sensible heat and latent heat of this compressed mixed gas are used as a heating source, whereby high purity liquid nitrogen taken out in a liquid phase state from the rectification column is evaporated so as to be recovered as a product of high purity nitrogen gas. As compared with a conventional unit in which latent heat of nitrogen gas taken out of the top of a rectification column is used as a heating source (shown in FIG. 7), accordingly, it is possible to set at a lower value the supply pressure of a gas which becomes a heating source necessary for evaporation of high purity liquid nitrogen, by utilization of the lowering of a liquefying pressure accompanied with the rise of the oxygen concentration.

Furthermore, the second heat exchanger which evaporates the high purity liquid nitrogen is disposed below a place where the high purity liquid nitrogen is taken out of the rectification column, and the pressure of the high purity nitrogen gas to be delivered can be therefore made higher than the pressure of the feed air compressor and other compressor by utilization of this liquid head.

As a result, it has become possible to lower the operation pressure of the rectification column by about 0.8–1.2 kg/cm$^2$, as compared with the conventional unit (FIG. 7). In accordance with this lowering of the operation pressure of the rectification column, a reflux ratio in the top of the rectification column has been reduced 1–2% and further an electric power consumption rate has been also reduced about 5%.

DESCRIPTION OF REFERENCE NUMERALS

Figure 1:
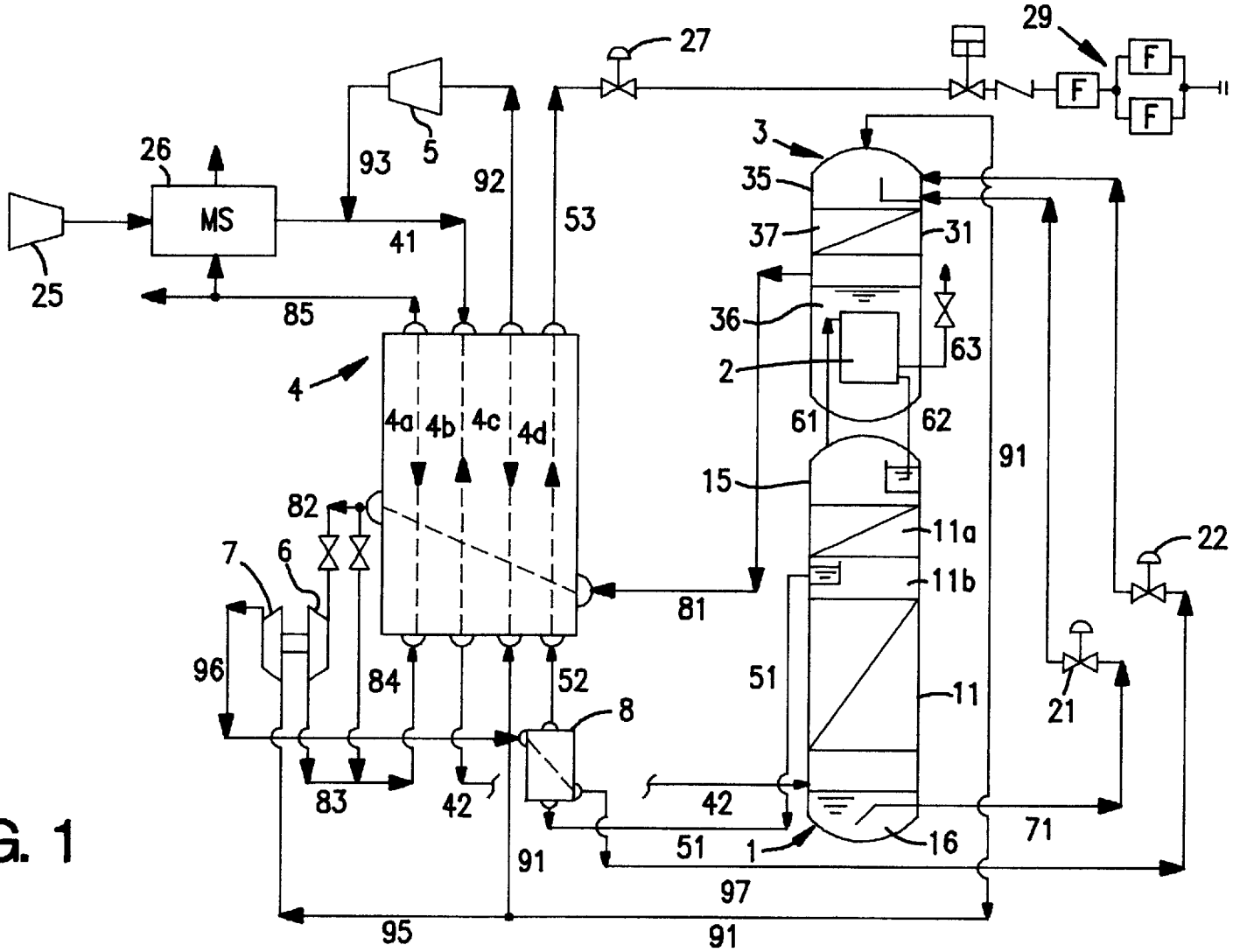
FIG. 1 is a schematic constructive view showing one example of the embodiments of the high purity nitrogen generator unit based on the present invention.
Figure 2:
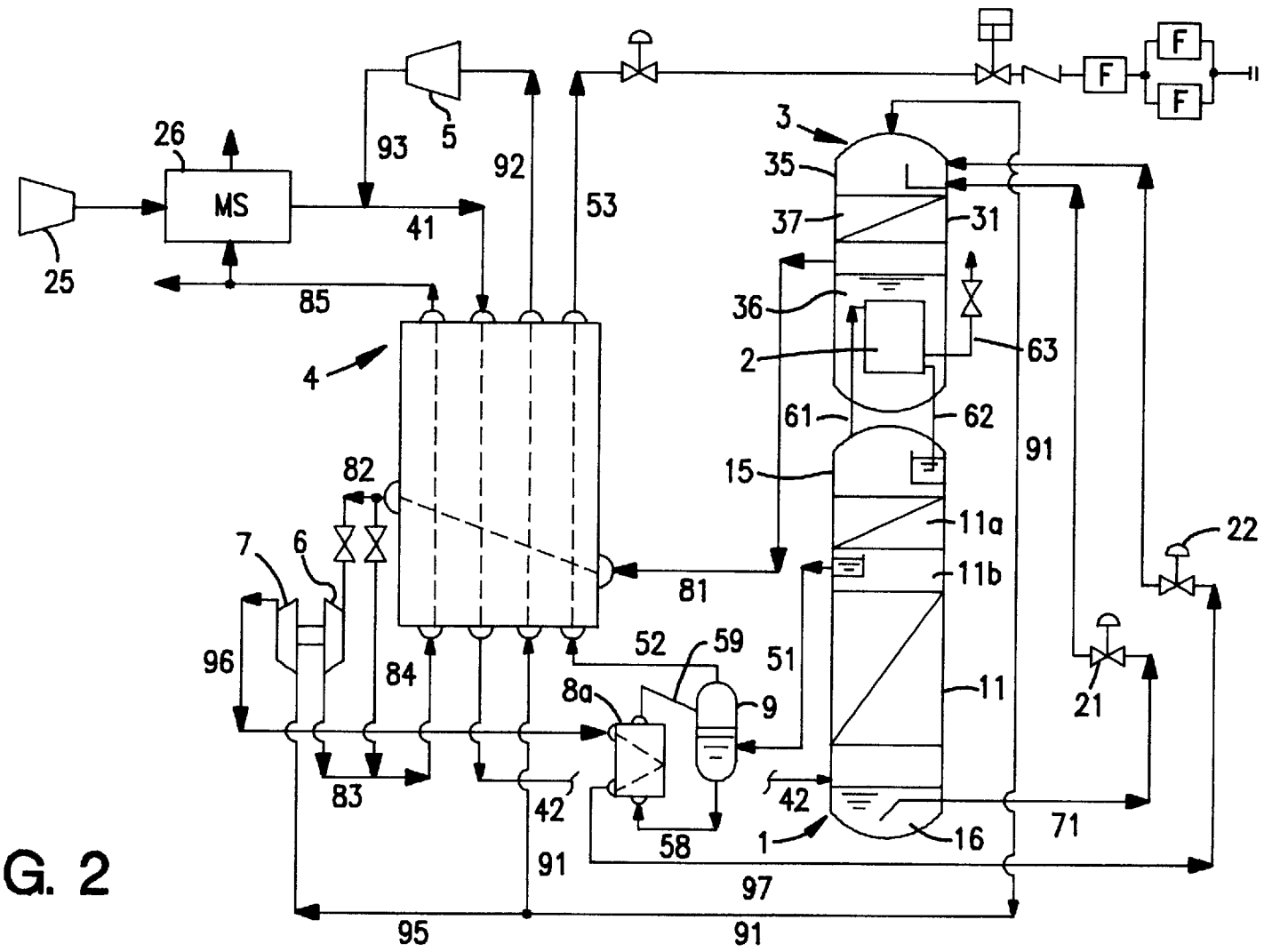
FIG. 2 is a schematic constructive view showing another example of the embodiments of the high purity nitrogen generator unit based on the present invention.
Figure 3:
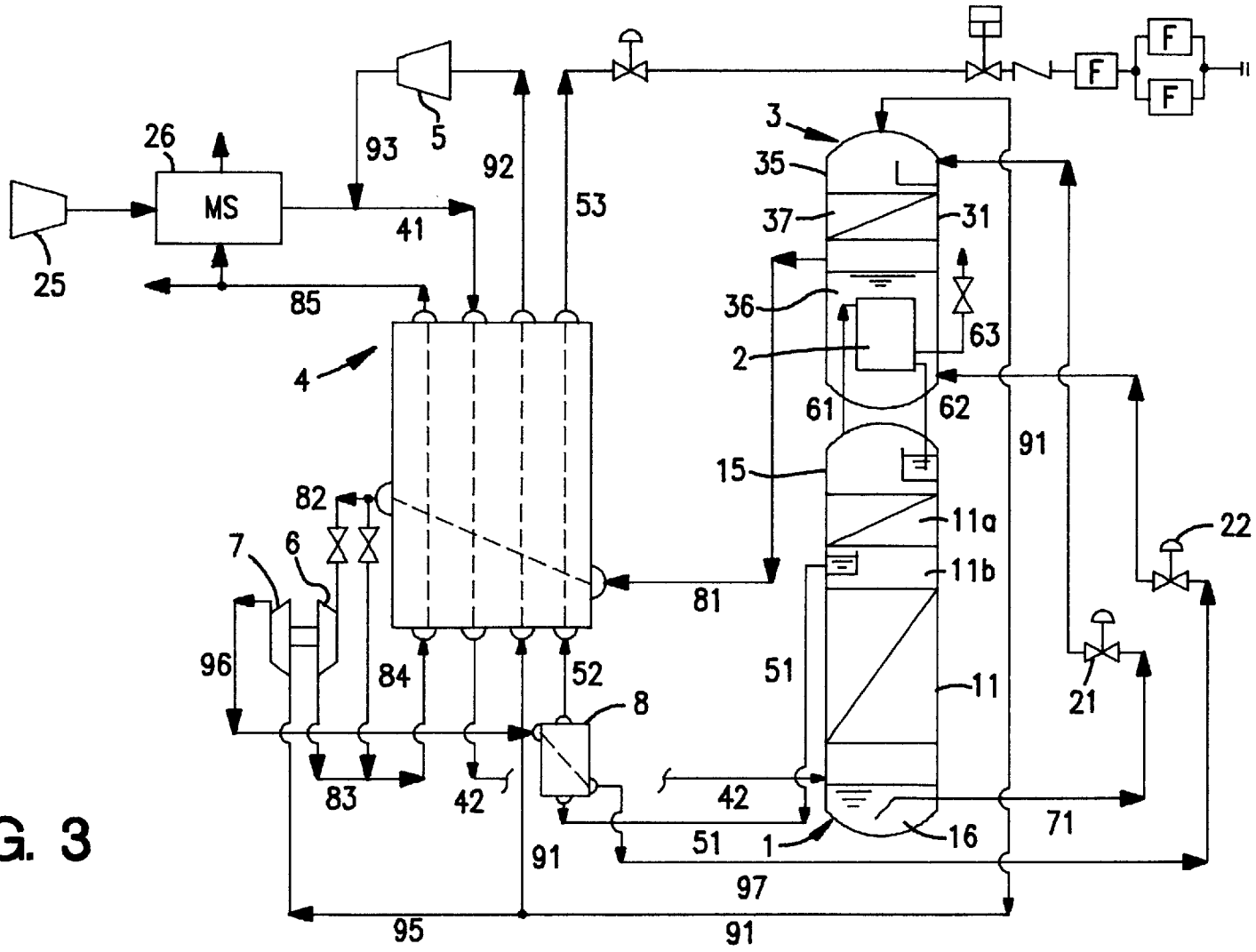
FIG. 3 is a schematic constructive view showing a further example of the embodiments of the high purity nitrogen generator unit based on the present invention.
Figure 4:
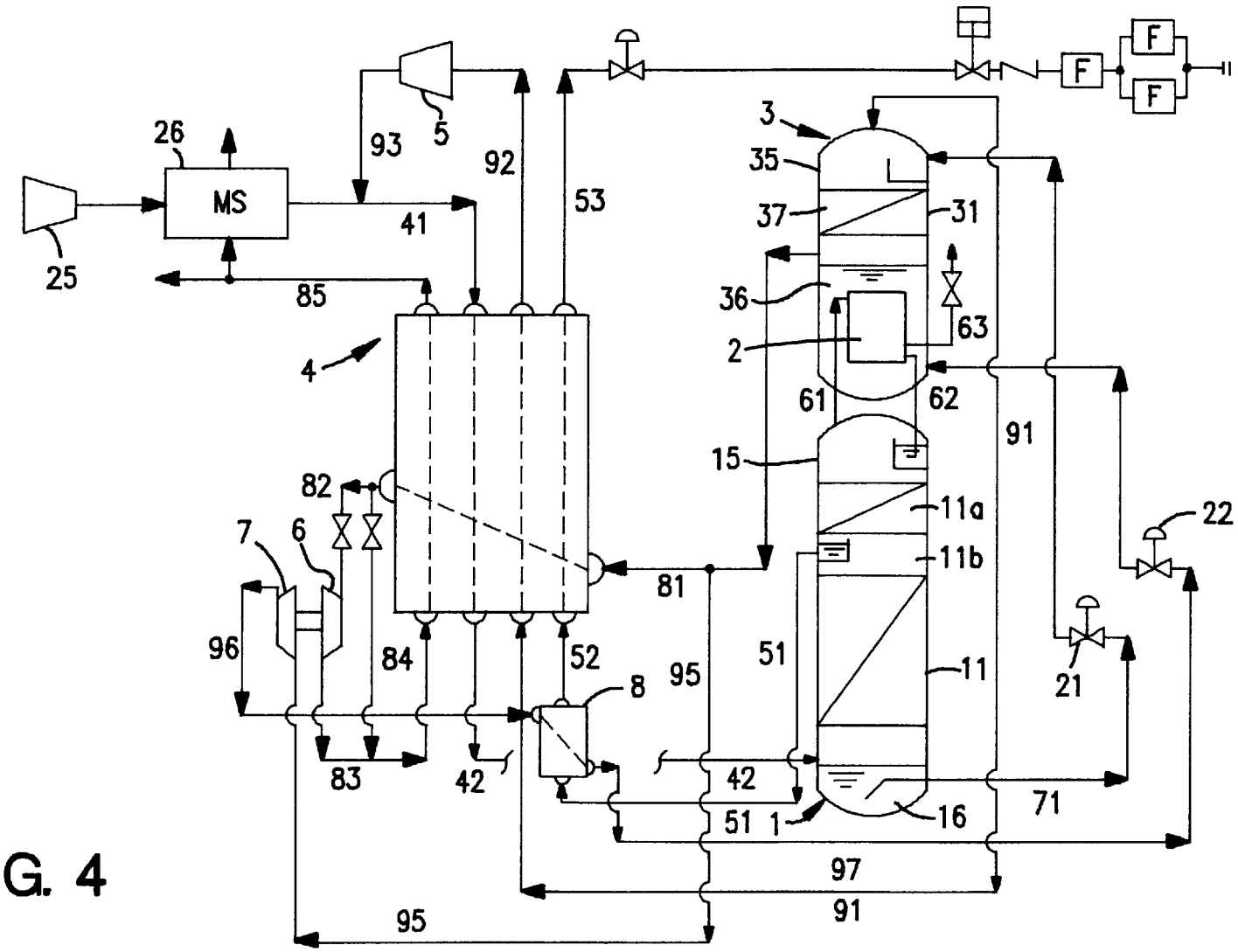
FIG. 4 is a schematic constructive view showing a further example of the embodiments of the high purity nitrogen generator unit based on the present invention.
Figure 5:
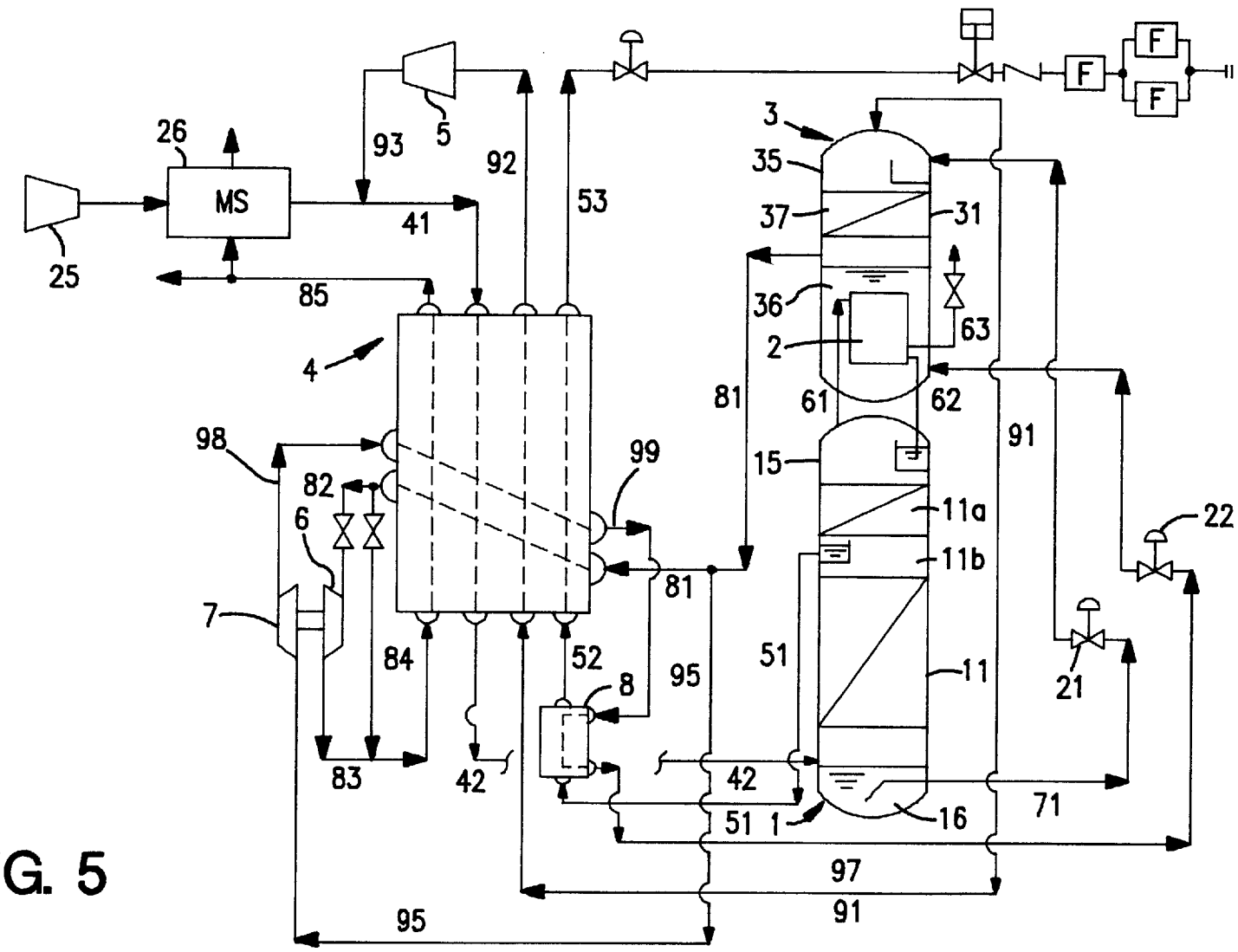
FIG. 5 is a schematic constructive view showing a further example of the embodiments of the high purity nitrogen generator unit based on the present invention.
Figure 6:
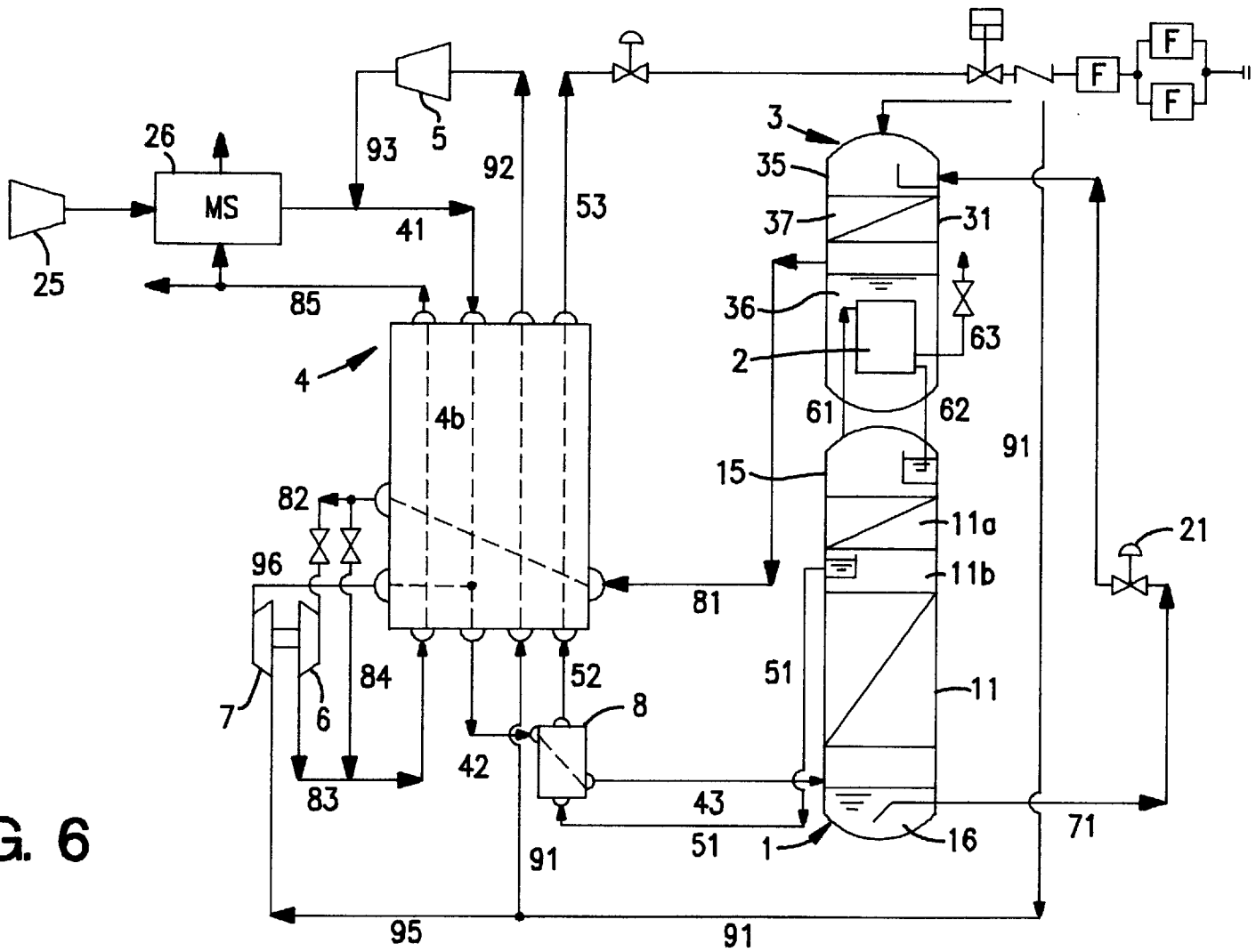
FIG. 6 is a schematic constructive view showing a further example of the embodiments of the high purity nitrogen generator unit based on the present invention.
Figure 8:
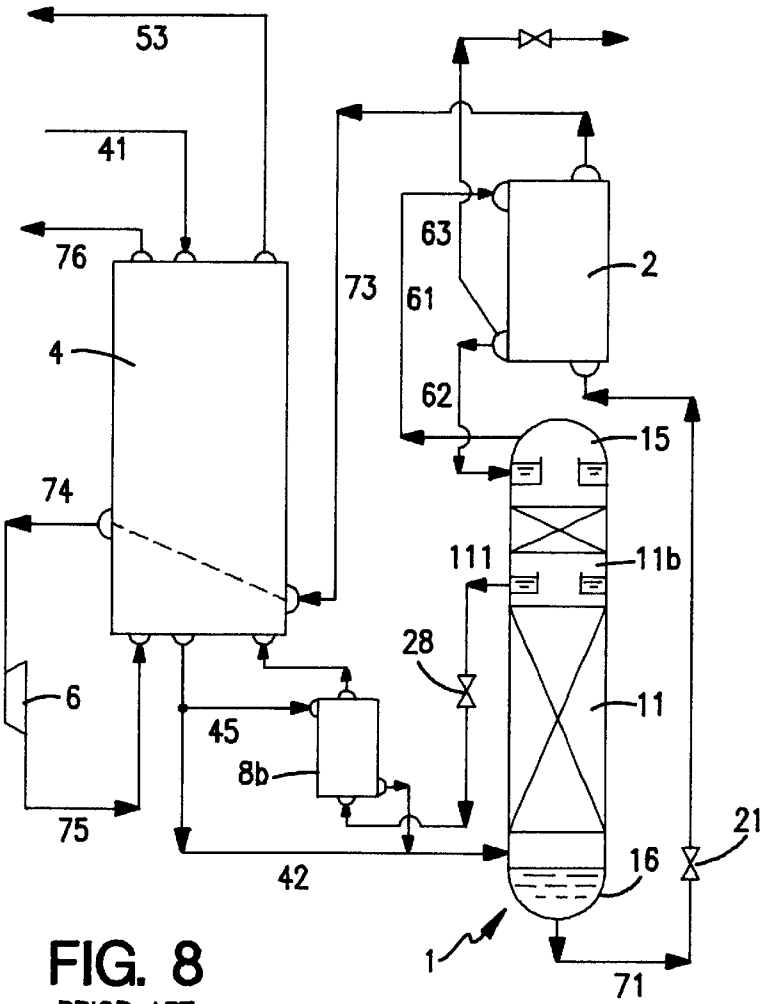
FIG. 8 PRIOR ART
FIG. 8 is a schematic constructive view showing another example of the high purity nitrogen generator unit of the prior art.
Figure 7:
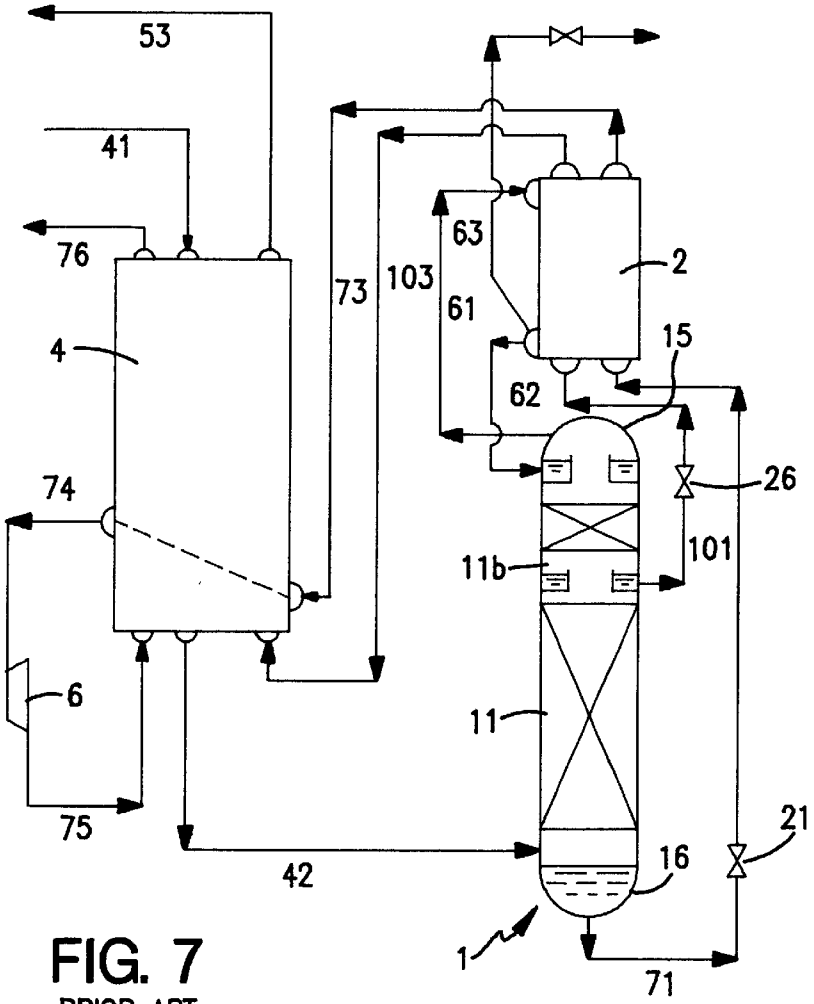
FIG. 7 PRIOR ART
FIG. 7 is a schematic constructive view showing one example of the high purity nitrogen generator unit of the prior art.

1—rectification column, 2—nitrogen condenser, 3—composition regulation column, 4—first heat exchanger, 5—first compressor (recycle compressor), 6—expansion turbine, 7—second compressor, 8—second heat exchanger, 8*a*—heat exchanger body, 9—gas-liquid separator, 21—first expansion valve, 22—second expansion valve, 25—feed air compressor, 26—molecular sieves column, 27—flow rate regulation valve, 29—filter, 11, 31—rectifying trays, 51, 52 & 53—product gas recovery line 81, 82, 83 & 85—gas discharge line, 91, 92 & 93—first circulation line, 95, 96 & 97 second circulation line.

I claim:

1. A high purity nitrogen generator unit, which comprises:

a first heat exchanger for cooling down feed compressed air;

a rectification column having rectifying trays, where the compressed air is introduced from the first heat exchanger into below said rectifying trays so as to be brought in a counter-current contact with a reflux liquid, whereby oxygen-rich liquid air is separated in its bottom and nitrogen gas in its top, respectively;

a first expansion valve for cooling down said oxygen-rich liquid air, introduced therein, through its reduction in pressure;

a composition regulation column having rectifying trays, where said oxygen-rich liquid air is introduced from the first expansion valve into above said rectifying trays, whereby oxygen-rich liquid air is separated in its bottom and a mixed gas of oxygen and nitrogen in its top, respectively;

a nitrogen condenser for cooling down said nitrogen gas introduced therein from the top of said rectification column through an indirect heat exchange with said oxygen-rich liquid air collected in the bottom of said composition regulation column, whereby the thus-condensed liquid nitrogen is supplied as said reflux liquid to above the rectifying trays of the rectification column and non-condensed gas is discharged to the outside;

a gas discharge line having an expansion turbine provided on the way, where oxygen-rich waste gas is recovered from the gas phase portion below the rectifying trays of the composition regulation column and introduced into this expansion turbine, and the oxygen-rich waste gas thus cooled through its reduction in pressure is introduced as a portion of a cooling medium into the first heat exchanger and then discharged to the outside;

a first circulation line having a first compressor provided on the way, where a portion of said mixed gas is introduced from the top of the composition regulation column into the first compressor, and the thus-compressed mixed gas is joined with said feed compressed air:

a second circulation line having a second compressor driven by said expansion turbine, a second heat exchanger and a second expansion valve, provided on the way, where another portion of said mixed gas is introduced from the top of the composition regulation column into the second compressor, and the thus-compressed mixed gas is introduced as a heating medium into the second heat exchanger and then introduced into the second expansion valve so as to be liquefied through its reduction in pressure, and the thus-liquefied gas is returned to above the rectifying trays of the composition regulation column; and a product gas recovery line for recovering high purity liquid nitrogen from a rectifying tray that is several stages below the top of the rectification column and bringing the recovered liquid nitrogen into a heat exchange with said mixed gas in the second heat exchanger, where the thus-evaporated high purity nitrogen gas is introduced as a portion of a cooling medium into the first heat exchanger and then recovered as a product.

2. A high purity nitrogen generator unit, which comprises:

a first heat exchanger for cooling down feed compressed air;

a rectification column having rectifying trays, where the compressed air is introduced from the first heat exchanger into below said rectifying trays so as to be brought in a counter-current contact with a reflux liquid, whereby oxygen-rich liquid air is separated in its bottom and nitrogen gas in its top, respectively;

a first expansion valve for cooling down said oxygen-rich liquid air, introduced therein, through its reduction in pressure;

a composition regulation column having rectifying trays, where said oxygen-rich liquid air is introduced from the first expansion valve into above said rectifying trays, whereby oxygen-rich liquid air is separated in its bottom and a mixed gas of oxygen and nitrogen in its top, respectively;

a nitrogen condenser for cooling down said nitrogen gas introduced therein from the top of said rectification column through an indirect heat exchange with said oxygen-rich liquid air collected in the bottom of said composition regulation column, whereby the thus-condensed liquid nitrogen is supplied as said reflux liquid to above the rectifying trays of the rectification column and non-condensed gas is discharged to the outside;

a gas discharge line having an expansion turbine provided on the way, where oxygen-rich waste gas is recovered from the gas phase portion below the rectifying trays of the composition regulation column and introduced into this expansion turbine, and the oxygen-rich waste gas thus cooled through its reduction in pressure is introduced as a portion of a cooling medium into the first heat exchanger and then discharged to the outside;

a first circulation line having a first compressor provided on the way, where a portion of said mixed gas is introduced from the top of the composition regulation column into the first compressor, and the thus-compressed mixed gas is joined with said feed compressed air:

a second circulation line having a second compressor driven by said expansion turbine, a second heat exchanger and a second expansion valve, provided on the way, where another portion of said mixed gas is introduced from the top of the composition regulation column into the second compressor, and the thus-compressed mixed gas is introduced as a heating medium into the second heat exchanger and then introduced into the second expansion valve so as to be liquefied through its reduction in pressure, and the thus-liquefied gas is returned to the bottom of the composition regulation column; and a product gas recovery line for recovering high purity liquid nitrogen from a rectifying tray that is several stages below the top of the rectification column and bringing the recovered liquid nitrogen into a heat exchange with said mixed gas in the second heat exchanger, where the thus-evaporated high purity nitrogen gas is introduced as a portion of a cooling medium into the first heat exchanger and then recovered as a product.

3. A high purity nitrogen generator unit, which comprises:

a first heat exchanger for cooling down feed compressed air;

a rectification column having rectifying trays, where the compressed air is introduced from the first heat exchanger into below said rectifying trays so as to be brought in a counter-current contact with a reflux liquid, whereby oxygen-rich liquid air is separated in its bottom and nitrogen gas in its top, respectively;

a first expansion valve for cooling down said oxygen-rich liquid air, introduced therein, through its reduction in pressure;

a composition regulation column having rectifying trays, where said oxygen-rich liquid air is introduced from the first expansion valve into above said rectifying trays, whereby oxygen-rich liquid air is separated in its bottom and a mixed gas of oxygen and nitrogen in its top, respectively;

a nitrogen condenser for cooling down said nitrogen gas introduced therein from the top of said rectification column through an indirect heat exchange with said oxygen-rich liquid air collected in the bottom of said composition regulation column, whereby the thus-condensed liquid nitrogen is supplied as said reflux liquid to above the rectifying trays of the rectification column and non-condensed gas is discharged to the outside;

a gas discharge line having an expansion turbine provided on the way, where a portion of oxygen-rich waste gas is recovered from the gas phase portion below the rectifying trays of the composition regulation column and introduced into this expansion turbine, and the oxygen-rich waste gas thus cooled through its reduction in pressure is introduced as a portion of a cooling medium into the first heat exchanger and then discharged to the outside;

a first circulation line having a first compressor provided on the way, where said mixed gas is introduced from the top of the composition regulation column into the first compressor, and the thus-compressed mixed gas is joined with said feed compressed air:

a second circulation line having a second compressor driven by said expansion turbine, a second heat exchanger and a second expansion valve, provided on the way, where another portion of said oxygen-rich waste gas is recovered from the gas phase portion below the rectifying trays of the composition regulation column and introduced into the second compressor, and the thus-compressed oxygen-rich waste gas is introduced as a heating medium into the second heat exchanger and then introduced into the second expansion valve so as to be liquefied through its reduction in pressure, and the thus-liquefied gas is returned to the bottom of the composition regulation column; and a product gas recovery line for recovering high purity liquid nitrogen from a rectifying tray that is several stages below the top of the rectification column and bringing the recovered liquid nitrogen into a heat exchange with said oxygen-rich waste gas in the second heat exchanger, where the thus-evaporated high purity nitrogen gas is introduced as a portion of a cooling medium into the first heat exchanger and then recovered as a product.

4. A high purity nitrogen generator unit, according to claim 3, in which said second circulation line having a second compressor driven by said expansion turbine, said first heat exchanger, a second heat exchanger and a second expansion valve, provided on the way, where another portion of said oxygen-rich waste gas is recovered from the gas phase portion below the rectifying trays of the composition regulation column and introduced into the second compressor, and the thus-compressed oxygen-rich waste gas is introduced as a heating medium into said first heat exchanger and then introduced as a heating medium into the second heat exchanger, and thereafter introduced into the second expansion valve so as to be liquefied through its reduction in pressure, and the thus-liquefied gas is returned to the bottom of the composition regulation column.

5. A high purity nitrogen generator unit, which comprises:

a first heat exchanger for cooling down feed compressed air;

a second heat exchanger for further cooling down the compressed air passed in the first heat exchanger through an indirect heat exchange with high purity liquid nitrogen to be recovered as a product;

a rectification column having rectifying trays, where the compressed air is introduced from the second heat exchanger into below said rectifying trays so as to be brought in a counter-current contact with a reflux liquid, whereby oxygen-rich liquid air is separated in its bottom and nitrogen gas in its top, respectively;

a first expansion valve for cooling down said oxygen-rich liquid air, introduced therein, through its reduction in pressure;

a composition regulation column having rectifying trays, where said oxygen-rich liquid air is introduced from the first expansion valve into above said rectifying trays, whereby oxygen-rich liquid air is separated in its bottom and a mixed gas of oxygen and nitrogen in its top, respectively;

a nitrogen condenser for cooling down said nitrogen gas introduced therein from the top of said rectification column through an indirect heat exchange with said oxygen-rich liquid air collected in the bottom of said composition regulation column, whereby the thus-condensed liquid nitrogen is supplied as said reflux liquid to above the rectifying trays of the rectification column and non-condensed gas is discharged to the outside;

a gas discharge line having an expansion turbine provided on the way, where oxygen-rich waste gas is recovered from the gas phase portion below the rectifying trays of the composition regulation column and introduced into this expansion turbine, and the oxygen-rich waste gas thus cooled through its reduction in pressure is introduced as a portion of a cooling medium into the first heat exchanger and then discharged to the outside;

a first circulation line having a first compressor provided on the way, where a portion of said mixed gas is introduced from the top of the composition regulation column into the first compressor, and the thus-compressed mixed gas is joined with said feed compressed air:

a second circulation line having a second compressor driven by said expansion turbine, provided on the way, where another portion of said mixed gas is introduced from the top of the composition regulation column into the second compressor, and the thus-compressed mixed gas is joined with said feed air in an intermediate part of the first heat exchanger; and a product gas recovery line for recovering high purity liquid nitrogen from a rectifying tray that is several stages below the top of the rectification column and bringing the recovered liquid nitrogen into a heat exchange with said mixed gas in the second heat exchanger, where the thus-evaporated high purity nitrogen gas is introduced as a portion of a cooling medium into the first heat exchanger and then recovered as a product.

6. A high purity nitrogen generator unit, according to claim 1, in which said second heat exchanger is disposed at a position that is lower than a place where high purity liquid nitrogen is taken out of said rectification column, and a height from said second heat exchanger up to said place is more than 10 m, but less than 15 m.

7. A high purity nitrogen generator unit, according to claim 1, in which said second heat exchanger is composed of a heat exchanger body and a gas-liquid separator, said gas-liquid separator is connected in parallel to a piping of said heat exchanger body on the cooling medium side, and said product gas recovery line is connected to the gas-liquid separator so that high purity nitrogen gas evaporated in the gas-liquid separator is recovered as a product.

8. A high purity nitrogen producing method which comprises, by use of a high purity nitrogen generator unit comprising:

a rectification column in which cooled compressed air is introduced therein so as to be brought into a counter-current contact with a reflux liquid, whereby oxygen-rich liquid air is separated in its bottom and nitrogen gas in its top, respectively, and in which high purity liquid nitrogen is taken out of the liquid phase portion in the vicinity of said top; and a composition regulation column in which said oxygen-rich liquid air is introduced therein so that a portion thereof is evaporated, whereby oxygen-rich liquid air is separated in its bottom and a mixed gas of oxygen and nitrogen in its top, respectively, compressing said mixed gas taken out of said composition regulation column so that it is elevated in temperature, and evaporating the high purity liquid nitrogen taken out of said rectification column through a heat exchange with the mixed gas which has been elevated in temperature.

9. A high purity nitrogen generator unit, according to claim 2, in which said second heat exchanger is disposed at a position that is lower than a place where high purity liquid nitrogen is taken out of said rectification column, and a height from said second heat exchanger up to said place is more than 10 m, but less than 15 m.

10. A high purity nitrogen generator unit, according to claim 3, in which said second heat exchanger is disposed at a position that is lower than a place where high purity liquid nitrogen is taken out of said rectification column, and a height from said second heat exchanger up to said place is more than 10 m, but less than 15 m.

11. A high purity nitrogen generator unit, according to claim 4, in which said second heat exchanger is disposed at a position that is lower than a place where high purity liquid nitrogen is taken out of said rectification column, and a height from said second heat exchanger up to said place is more than 10 m, but less than 15 m.

12. A high purity nitrogen generator unit, according to claim 5, in which said second heat exchanger is disposed at a position that is lower than a place where high purity liquid nitrogen is taken out of said rectification column, and a height from said second heat exchanger up to said place is more than 10 m, but less than 15 m.

13. A high purity nitrogen generator unit, according to claim 2, in which said second heat exchanger is composed of a heat exchanger body and a gas-liquid separator, said gas-liquid separator is connected in parallel to a piping of said heat exchanger body on the cooling medium side, and said product gas recovery line is connected to the gas-liquid separator so that high purity nitrogen gas evaporated in the gas-liquid separator is recovered as a product.

14. A high purity nitrogen generator unit, according to claim 3, in which said second heat exchanger is composed of a heat exchanger body and a gas-liquid separator, said gas-liquid separator is connected in parallel to a piping of said heat exchanger body on the cooling medium side, and said product gas recovery line is connected to the gas-liquid separator so that high purity nitrogen gas evaporated in the gas-liquid separator is recovered as a product.

15. A high purity nitrogen generator unit, according to claim 4, in which said second heat exchanger is composed of a heat exchanger body and a gas-liquid separator, said gas-liquid separator is connected in parallel to a piping of said heat exchanger body on the cooling medium side, and said product gas recovery line is connected to the gas-liquid separator so that high purity nitrogen gas evaporated in the gas-liquid separator is recovered as a product.

16. A high purity nitrogen generator unit, according to claim 5, in which said second heat exchanger is composed of a heat exchanger body and a gas-liquid separator, said gas-liquid separator is connected in parallel to a piping of said heat exchanger body on the cooling medium side, and said product gas recovery line is connected to the gas-liquid separator so that high purity nitrogen gas evaporated in the gas-liquid separator is recovered as a product.

* * * * *

UNITED STATES PATENT AND TRADEMARK OFFICE

CERTIFICATE OF CORRECTION

PATENT NO. : 5,806,340

DATED : September 15, 1998

INVENTOR(S) : Shinji TOMITA

It is certified that error appears in the above-indentified patent and that said Letters Patent is hereby corrected as shown below:

On the title page, insert Item [30] as follows:

--[30] Foreign Application Priority Data

May 29, 1996 [JP] Japan.....135147/1996--.

Signed and Sealed this

Twenty-first Day of December, 1999

*Attest:*

Q. TODD DICKINSON

*Attesting Officer*

*Acting Commissioner of Patents and Trademarks*